US005083967A

United States Patent [19]

Yokoe et al.

[11] Patent Number: 5,083,967

[45] Date of Patent: Jan. 28, 1992

[54] FIBER FOR DOLL'S HAIR

[75] Inventors: Masaaki Yokoe, Kakogawa; Hiroshi Yokoyama, Akashi; Yoshihiro Mizumoto, Takasago, all of Japan

[73] Assignee: Kanegafuchi Kagaku Kogyo Kabushiki Kaisha, Osaka, Japan

[21] Appl. No.: 486,699

[22] Filed: Mar. 1, 1990

Related U.S. Application Data

[62] Division of Ser. No. 196,516, May 20, 1988, abandoned.

[30] Foreign Application Priority Data

May 23, 1987 [JP] Japan ..... 62-126314

[51] Int. Cl.[5] ..... A63H 3/44; A63H 3/36; A41G 3/00; C08F 220/44

[52] U.S. Cl. ..... 446/394; 446/385; 132/53; 428/15; 526/342

[58] Field of Search ..... 428/15; 526/342; 446/385, 394, 391, 372, 319, 296; 132/201, 53, 54, 56

[56] References Cited

U.S. PATENT DOCUMENTS

| | | | |
|---|---|---|---|
| 2,636,460 | 4/1953 | Seiderman | 132/201 |
| 2,670,570 | 3/1954 | Gnaizda | 132/201 X |
| 3,003,155 | 10/1961 | Mielzynski et al. | 132/53 X |
| 3,614,843 | 10/1971 | Hautin et al. | 132/53 X |
| 3,674,631 | 7/1972 | Schwarz | 162/149 |
| 3,765,123 | 10/1973 | Terzian | 446/394 |
| 3,786,822 | 1/1974 | Kimura | 132/53 |
| 4,012,346 | 3/1977 | Makiyama | 260/17 A |
| 4,311,761 | 1/1982 | Kanbara et al. | 132/56 X |
| 4,390,572 | 6/1983 | Okamoto et al. | 428/15 |
| 4,674,169 | 6/1987 | Katzman et al. | 132/56 X |
| 4,880,428 | 11/1989 | Yamada | 132/53 X |

FOREIGN PATENT DOCUMENTS

| | | | |
|---|---|---|---|
| 0125574 | 11/1984 | European Pat. Off. . | |
| 0230634 | 8/1987 | European Pat. Off. | 132/201 |
| 2300495 | 4/1974 | Fed. Rep. of Germany | 446/394 |
| 0191496 | 8/1986 | Japan | 446/319 |
| 0289105 | 12/1986 | Japan | 132/201 |
| 1006119 | 1/1989 | Japan | 132/201 |
| 2167997A | 11/1985 | United Kingdom . | |

*Primary Examiner*—Robert A. Hafer
*Assistant Examiner*—D. Neal Mun
*Attorney, Agent, or Firm*—Armstrong, Nikaido, Marmelstein, Kubovcik & Murray

[57] ABSTRACT

A doll having hair comprising synthetic fiber consisting essentially of an acrylonitrile polymer comprising 30 to 80% by weight of an acrylonitrile and 70 to 20% by weight of at least one of a vinyl chloride and a vinylidene chloride. The fiber hair of the invention have the excellent flame resistance, the natural touch, the natural and quiet luster, the excellent curl retention and the excellent bulkiness.

3 Claims, 2 Drawing Sheets

FIBER FOR DOLL'S HAIR

This is a division of application Ser. No. 196,516 filed May 20, 1988 now abandoned.

BACKGROUND OF THE INVENTION

The present invention relates to a fibers suitable for use as hairs of a doll, and more particularly to a synthetic fiber suitable for use as hairs of a doll, consisting essentially of an acrylic polymer comprising 30 to 80% by weight of an acrylonitrile and 70 to 20% by weight of at least one vinyl chloride and vinylidene chloride. The synthetic fiber suitable for use as doll's hairs of the present invention has an excellent flame resistance, is not sticky but natural in touch like human hairs, is not shiny, the too shiny luster being synthetic fibers' own, but has a natural and quiet luster like human hairs, has an excellent curl retention, therefore the hairstyle can stay for a long time, and has a remarkably improved bulkiness. That is, the synthetic fiber of the invention is very close to human hairs in the touch, the appearance, and the like.

Generally, fibers suitable for use as hairs of a doll (hereinafter referred to as "fibers for doll's hairs") are continuously rooted in a head of a doll made of a vinyl chloride by using a rooting machine. As the fibers for doll's hairs, only a multifilament having a fineness of 200 to 2,000 deniers can be used in the state of a curled yarn or a straight yarn, since the fibers for doll's are rooted on the doll's head in the limited conditions as mentioned above.

Hitherto, synthetic fibers such as vinylidene chloride fibers, vinyl chloride fibers, nylon fibers and polypropylene fibers have been used as the fibers for doll's hair.

These synthetic fibers can be produced, as known, as multifilaments according to a melt-extrusion spinning or a melt spinning, and the obtained multifilaments are winded to a spool. All of the synthetic fibers for doll's hairs are produced by the melt-extrusion spinning or the melt spinning since the multifilaments can be easily produced according to the above-mentioned spinnings. However, the thus obtained multifilaments have various defects as the fiber for the doll's hairs, as mentioned below, because the fibers are produced according to the melt-extrusion or melt spinning through a nozzle with orifices having a round shape.

FIG. 2*a* and FIG. 2*b* are scanning electron microphotographs (five hundreds magnifications). FIG. 2*a* shows a cross-sectional shape of a conventional fiber for doll's hairs and FIG. 2 shows a side shape of the conventional fiber.

As shown in FIGS. 2*a* and 2*b*, the conventional fibers for the doll's hairs are round in the shape of their cross section, and are very smooth in their surface, which is characteristic in fibers produced by the melt spinning. Also, the fibers for the doll's hairs do not vary in the cross-sectional shape and the surface with kinds of used polymers, as shown in Table 1 mentioned below.

Recently, the diversification of the qualities in the fibers for the doll's hairs have been required in the same level as in hair wigs. That is, not only straight fibers but also curled fibers with various sizes in a curl are rooted in the heads of the dolls. Also, the hairstyles of dolls have been variously designed.

Accordingly, it is required to improve the properties of the fiber for doll's hairs, such as the touch, curl retention, bulkiness and luster.

Further, in recent years, in the toy industry, the flame resistance of the fibers for the doll's hairs is required in order to more improve the safety.

However, in spite that there are the above-mentioned requirements, with the diversification of the hairstyles of dolls, the fact is that the fiber for doll's hairs has been hardly improved in its properties.

The known fibers for doll's hairs are poor in the bulkiness and therefore the surface of the doll's head is easily seen, because the fibers are easily stuck together to form a closed-packed state and become in a state such as teeth of a comb owing to the round cross-sectional shape and the smooth surface in the fibers. Also, since the fibers have no scales on the surface unlike the human hairs and are very smooth in the surface, the fibers are far from the natural hairs in the touch. For instance, they are sticky or the greasy touch is strongly felt when touching the fibers with hands. Also, the fibers are too shiny, which is the synthetic fibers' own, since in the fibers light is reflected only in one direction. In addition, since the fibers are insufficient in the curl retention and low in the bulkiness, it is necessary to increase the amount of the fibers to be rooted on the doll's head.

The properties of the conventional fibers for doll's hairs are shown in Table 1.

TABLE 1

| | Specific gravity | Cross-sectional shape | Flame resistance | Touch | Curl retention | Bulkiness | Luster |
|---|---|---|---|---|---|---|---|
| Vinylidene chloride fiber | 1.70 | Round | ○*1 | X | X | X | X |
| Vinyl chloride fiber | 1.39 | " | ○ | X | Δ*2 | X | X |
| Nylon fiber | 1.14 | " | X*3 | X | X | X | X |
| Polypropylene fiber | 0.91 | " | X | X | Δ | ○ | X |

(Notes)
*1○: Excellent
*2Δ: A little poor
*3X: Poor

The vinylidene chloride fibers and the vinyl chloride fibers have been widely used because of their excellent flame resistance. However, the vinylidene chloride fibers are the highest in the specific gravity and are poor in the resilience, therefore, the fibers are poor in the curl retention. Also, the vinylidene chloride fibers are one of the fibers having the lowest bulkiness among the fibers for doll's hairs. On the other hand, the vinyl chloride fibers are a little better than the vinylidene chloride fibers in the curl retention and bulkiness, but their properties are still unsatisfactory as the fibers for the doll's hairs.

Since these two fibers are high in the chlorine content, their specific gravities are higher than those of other fibers, resulting in lowering the bulkiness thereof.

The nylon fibers have a defect such that the curled fibers are easily straightened with moisture. The polypropylene fibers are low in the specific gravity and excellent in the bulkiness, but they are poor in the flame resistance, as well known. The nylon fibers are also poor in the flame resistance.

As mentioned above, the conventional fibers for the doll's hairs have the various defects, though there are some differences in properties depending on the kinds of the polymers, such that they are sticky, the greasy touch is strongly felt, they are too shiny, they are insufficient in the curl retention and it is necessary to increase the amount of the fibers to be rooted on the doll's head because the fibers tend to stick together to form a state such as teath of a comb and are low in the bulkiness, therefore, the surface of the doll's head is easily seen. The above-mentioned defects of the conventional fibers for the doll's hairs have not been improved at all though the hairstyles of the dolls have been diversified and it has been strongly desired to improve the properties of the fibers for the doll's hairs from the market.

An object of the present invention is to provide fibers for doll's hairs with no defects aforementioned, which have the excellent flame resistance, the natural touch with no stickiness, the natural and quiet luster, the excellent curl retention, the excellent property for staying the hairstyle and the remarkably improved bulkiness, and therefore which are very close to natural human hairs.

The above and other objects of the present invention will become apparent from the description hereinafter.

SUMMARY OF THE INVENTION

It has now been found that synthetic fibers prepared according to a wet spinning or dry spinning from an acrylic polymer comprising 30 to 80% by weight of acrylonitrile and 70 to 20% by weight of at least one vinyl chloride and vinylidene chloride have excellent properties as the fibers for the doll's hairs.

That is, in accordance with the present invention, there is provided a synthetic fiber suitable for use as doll's hairs, consisting essentially of an acrylonitrile polymer comprising 30 to 80% by weight of an acrylonitrile and 70 to 20% by weight of at least one of a vinyl chloride and a vinylidene chloride. The fibers for the doll's hairs has the excellent flame resistance, no stickiness, the natural luster, the excellent curl retention for staying the hairstyle for a long time, and the excellent bulkiness.

DETAILED DESCRIPTION

As the acrylonitrile polymer in the present invention, both a mixture of acrylonitrile homopolymer and a polymer of vinyl chloride and/or vinylidene chloride or a copolymer of vinyl chloride and vinylidene chloride, and a copolymer of acrylonitrile with vinyl chloride and/or vinylidene chloride can be used. Also, it is possible to use the polymer further containing, in addition to acrylonitrile and vinyl chloride and/or vinylidene chloride, a vinyl monomer copolymerizable therewith.

The acrylonitrile polymer is composed of 30 to 80% by weight of acrylonitrile and 70 to 20% by weight of at least one vinyl chloride and vinylidene chloride, and more preferably, the acrylonitrile polymer is composed of 40 to 70% by weight of acrylonitrile and 60 to 30% by weight of at least one vinyl chloride and vinylidene chloride.

When the content of at least one vinyl chloride and vinylidene chloride is less than 20% by weight, a high flame resistance is hard to obtain. On the other hand, when the content of acrylonitrile is less than 30% by weight, an excellent curl retention and bulkiness are hard to obtain. As mentioned above, since the higher the specific gravity of the fiber, the lower the bulkiness, it is desirable that not less than 30% by weight of acrylonitrile is used to give a fiber having a specific gravity of not more than 1.5, for obtaining the excellent bulkiness. Also, it is necessary that the content of acrylonitrile is not less than 30% by weight for obtaining the excellent curl retention by improving the orientation of the fibers.

Figure 1A:
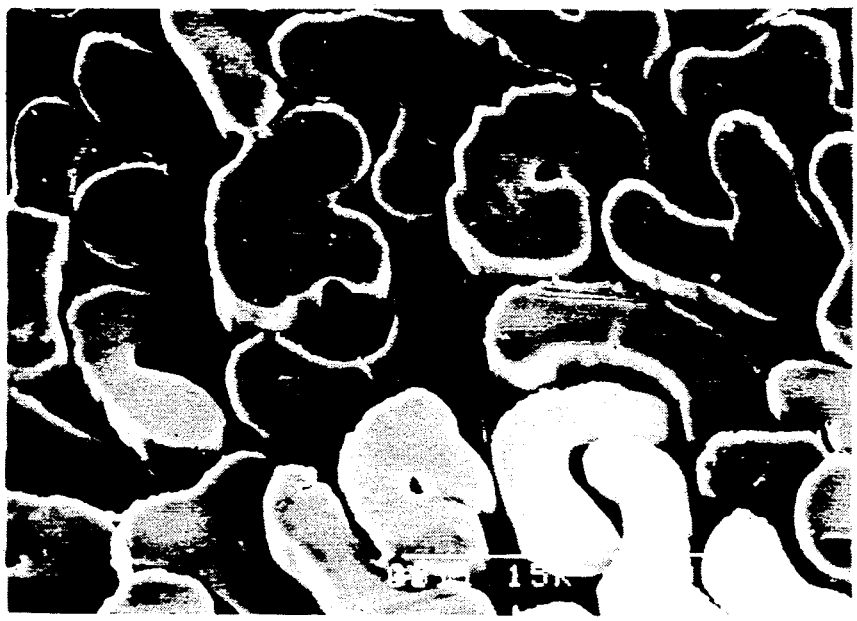
FIG. 1*a* is a scanning electron microphotograph showing a cross-sectional shape of an embodiment of fibers for doll's hairs of the present invention.
Figure 1B:
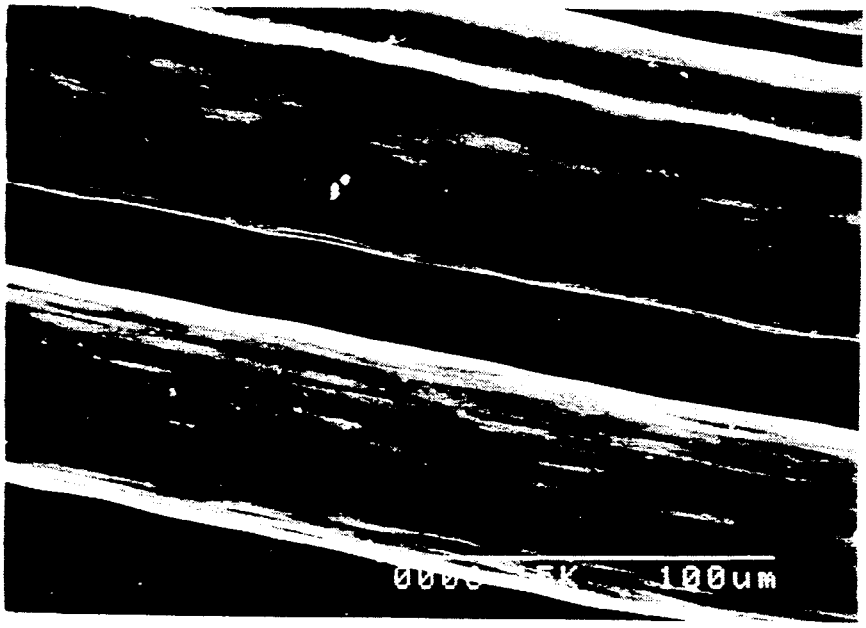
FIG. 1*b* is a scanning electron microphotograph showing a side shape of the fiber shown in FIG. 1*a;*
Figure 2A:
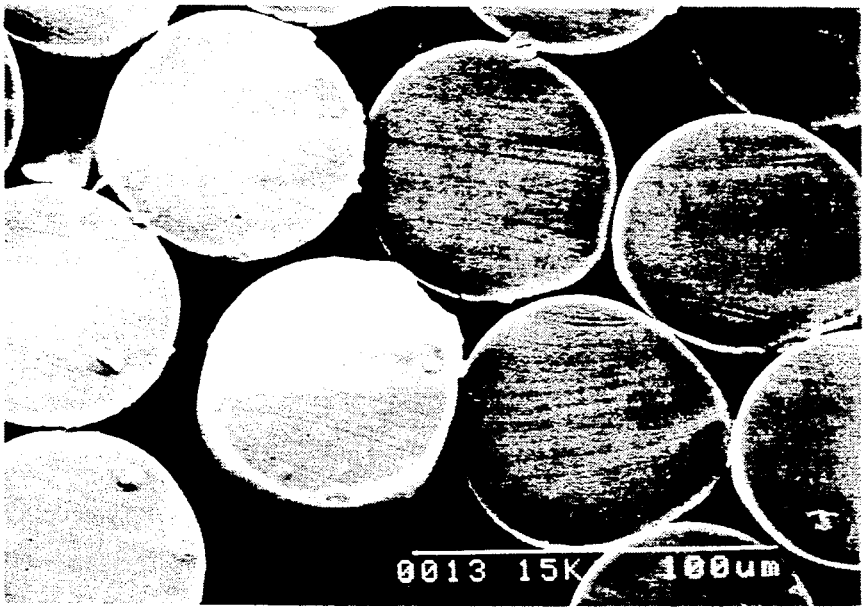
FIG. 2*a* is a scanning electron microphotograph showing a cross-sectional shape of an embodiment of conventional fibers for the doll's hair.
Figure 2B:
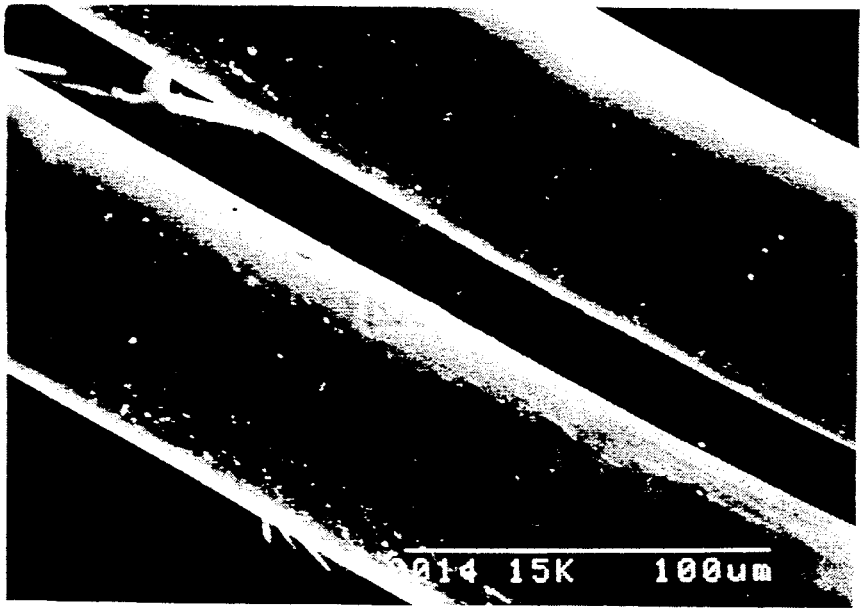
FIG. 2*b* is a scanning electron microphotograph showing a side shape of the fiber shown in FIG. 2*a*.

Examples of the vinyl monomers copolymerizable with acrylonitrile, vinyl chloride and vinylidene chloride are, for instance, vinyl acetate, acrylamide, methacrylamide, an acrylic acid or its ester, methacrylic acid or its ester, and the like. Also, vinyl monomers such as sulfopropyl methacrylate, sodium p-styrenesulfonate, sodium allylsulfonate and sodium methallylsulfonate may be used for improving the dyeing ability of the fibers as the vinyl monomer. These vinyl monomers may be used alone or as an admixture thereof. The content of the vinyl monomer is from 0 to 10% by weight, preferably from 0.5 to 5.0% by weight FIG. 1*a* and FIG. 1*b* are scanning electron microphotographs (five hundreds magnifications). FIG. 1*a* shows a shape of cross-section of the fiber for the doll's hairs of the present invention, and FIG. 1*b* shows a side shape of the fiber shown in FIG. 1*a*. As shown in FIG. 1*b*, on the surface of the fibers of the invention, there are fine unevennesses having irregular shape along the direction of a vertical axis, and the height of the unevenness from its bottom to its top is not more than 5 $\mu$. The height of the unevenness is measured from lines of the unevenness in the fiber shown in the scanning electron microphotograph.

Since the surface of the fibers of the invention is uneven, light is reflected in various directions, so the fibers are not shiny but have the natural luster. Also, the fibers are not sticky but have the natural touch. Further the fibers do not tend to stick together, so the bulkiness is excellent. In addition, the fibers are easy to entangle together, so the hairstyle can stay for a long time.

The fibers for the doll's hair consisting essentially of the acrylonitrile fiber of the invention have excellent bulkiness such that the weight of the fibers to be rooted on one head of a doll can be reduced to 60 to 50% of the weight to be rooted of the conventional fibers comprising, for instance, the vinylidene chloride fibers, in addition to the excellent curl retention and the low specific gravity and the fibers are hard to stick together due to the unevenness of the surface.

The height of the unevenness from the bottom to the top is from 0.1 to 5 $\mu$. When the height of the unevenness is less than 0.1 $\mu$, the touch and the luster cannot be improved, since the surface is not substantially different from smooth surfaces of the conventional fibers. On the other hand, when the height is more than 5 μ, the surface of the fibers is so rough that it is difficult to comb the doll's hairs, therefore the productivity in a making step of hairstyles of dolls becomes poor.

It is necessary that the fibers for the doll's hairs of the invention are multifilaments, since the fibers are rooted on the doll's head by using a rooting machine.

In order to utilize the fiber as the fibers for the doll's hairs, it is preferable that the multifilament has a fineness of 200 to 2,000 deniers and has monofilaments with a fineness of 10 to 100 deniers.

Although there are hair wigs made of acrylic fibers, the hair wigs are usually prepared according to a method in which bundles of fibers of tows having a fineness of several hundred thousands deniers and having a suitable staple length are rooted on a net by using a sawing machine and wefts are formed. Therefore, the fibers for the doll's hairs are quite different from the fibers suitable for use as hair wigs.

The fibers for the doll's hairs of the invention have irregular shapes in the cross-sectional shape. Examples of the irregular cross-sectional shapes are, for instance, a horseshoe-shaped cross-sectional shape, a cocoon-shaped cross-sectional shape, an L-shaped cross-sectional shape, a Y-shaped cross-sectional shape, a round cross-sectional shape, and the like. It is preferable that the fibers have the cross-sectional shapes of two or more kinds of the above-mentioned irregular shapes. It can be expected to more improve the bulkiness or the touch by combining the fibers having different irregular cross-sectional shapes from with one another.

The fibers for the doll's hairs of the invention can be prepared in usual manners such as wet spinnings and dry spinnings. That is, the fibers of the invention can be prepared from the acrylonitrile polymer according to a usual wet spinning. In such a case, the unevenness on the fibers' surface can be obtained by suitably controlling conditions in the wet spinning, such as a concentration of a solvent in a coagulating bath and a temperature of a coagulating bath. Also, the unevenness on the fibers can be obtained by adding an organic delustering agent such as cellulose acetate in a suitable amount. Examples of the solvents in the coagulating bath are, for instance, dimethyl formamide, dimethyl acetoamide, acetone, dimethyl sulfoxide, and the like.

In case of the dry spinning, it is usually impossible to obtain fibers having unevennesses on their surfaces such as the fibers obtained in wet spinning, since the solvent is diffused in one direction in a coagulating step. Accordingly, the delustering agent such as cellulose acetate is added to a spinning solution, for obtaining the fibers uneven on their surfaces.

The present invention is more specifically described and explained by means of the following Examples and Comparative Examples in which all parts and % are by weight unless otherwise noted. It is to be understood that the present invention is not limited to the Examples, and various changes and modifications may be made in the invention without departing from the spirit and scope thereof.

EXAMPLE 1

An acrylonitrile copolymer of 50% of acrylonitrile, 49% of vinyl chloride and 1.0% of sodium methallylsulfonate was dissolved in acetone to give a 28 spinning solution. The obtained spinning solution was extruded into a coagulation bath containing an acetone-water mixed solvent having a concentration of acetone of 20% and having a temperature of 25° C., at a spinning rate of 20 m/min through a spinning nozzle with 24 holes having a diameter of 0.3 mm to give a multifilament. Then, the formed multifilament was washed with water, dried and subjected to drawing with heat in a usual manner. The obtained multifilament (720 d/24 f) was winded round a spool.

The fiber had many unevennesses on its surface along the axial direction. The height of the unevenness from the bottom to the top was not more than about 1 μ.

The fiber was curled in a curl diameter of 13 mm by using a curling machine. The curled fibers were rooted on a doll's head by using a rooting machine.

With respect to the fiber curled, the flame resistance, touch, curl retention, bulkiness and luster were examined.

The touch, curl retention, bulkiness and luster of the fiber were estimated respectively by a beautician.

O : Excellent

Δ: A little poor

X : Poor

The flame resistance was estimated with an LOI value.

O : Excellent

X : Poor

In the bulkiness, an amount of the fiber rooted on the doll's head required to obtain a definite bulkiness was weighed.

The results are shown in Table 2.

EXAMPLE 2

The same acrylonitrile copolymer as used in Example 1 was dissolved in dimethyl formamide to give a 25% spinning solution. The obtained spinning solution was extruded into a coagulation bath containing a dimethyl formamide-water mixed solvent having a concentration of dimethyl formamide of 30% and having a temperature of 25° C., at a spinning rate of 20 m/min through a spinning nozzle with 24 holes having a diameter of 0.3 mm to give a multifilament. Then, the formed multifilament was washed with water, dried and subjected to drawing with heat in a usual manner. The thus obtained multifilament (720 d/24 f) was winded round a spool.

The fiber had many unevennesses on its surface along the axial direction. The height of the unevenness from the top to the bottom was not more than about 1 μ.

The fibers were curled and rooted on the doll's head, and the properties of the fiber were examined in the same manner as in Example 1. The results are shown in Table 2.

EXAMPLE 3

An acrylonitrile copolymer of 59% of acrylonitrile, 40% of vinylidene chloride and 1.0% of sodium methallylsulfonate was dissolved in dimethyl formamide to give a 25% spinning solution. The obtained spinning solution was extruded into a coagulation bath containing a dimethyl formamide-water mixed solvent having a concentration of dimethyl formamide of 60% and having a temperature of 25° C., at a spinning rate of 20 m/min through a spinning nozzle with 24 holes having a diameter of 0.4 mm to give a multifilament. Then, the multifilament was washed with water, dried and subjected to drawing with heat in a usual manner. The thus obtained multifilament (720 d/24 f) was winded round a spool.

The fiber had linear unevennesses on the surface along the axial direction. The height of the unevenness from the bottom to the top was not more than 1 μ.

The fiber was curled and rooted on the doll's head, and the properties of the fiber were examined in the same manner as in Example 1. The results are shown in Table 2.

COMPARATIVE EXAMPLES 1 AND 2

With respect to a vinylidene chloride fiber (Comparative Example 1) and a vinyl chloride fiber (Comparative Example 2), which have been used presently as the fibers for the doll's hairs, the flame resistance, touch, curl retention, bulkiness and luster were examined in the same manner as in Example 1, respectively. The results are shown in Table 2.

TABLE 2

| | d/f*1 | Flame resistance | Touch | Curl retention | Bulkiness | Luster |
|---|---|---|---|---|---|---|
| Ex. 1 | 720/24 | ○ | ○ | ○ | ○ (10 g) | ○ |
| Ex. 2 | 720/24 | ○ | ○ | ○ | ○ (12 g) | ○ |
| Ex. 3 | 720/24 | ○ | ○ | ○ | ○ (12 g) | ○ |
| Com. Ex. 1 (Vinylidene chloride fiber) | 1200/20 | ○ | X (Sticky) | X | X (20 g) | X |
| Com. Ex. 2 (Vinyl chloride fiber) | 900/20 | ○ | X (Sticky) | Δ | X (16 g) | X |

(Note)*1: The fineness of the multifilament (denier)/the number of the monofilaments in the multifilament From the results shown in Table 2, the fibers for the doll's hairs of the present invention are remarkably improved in the bulkiness, that is, the amount of the fiber of the invention to be rooted on the doll's head can be reduced to 60 to 50% of the vinylidene chloride fiber conventionally used.

In addition, the fibers of the invention are not shiny but have the natural and quiet luster. Also, they are not sticky and not greasy but are natural in the touch. Further, the fibers of the invention have the excellent curl retention and the hairstyles can stay for a long time.

As aforementioned, the hairs of dolls having the excellent flame resistance, the natural touch with no stickiness, the natural and quiet luster with no too shiny luster, the excellent curl retention so the hairstyle being able to stay for a long time, and the remarkably improved bulkiness can be obtained from the fibers for the doll's hairs of the invention. That is, the doll's hairs of the fibers of the invention are natural and are very close to the human hairs.

Also, the amount of the fibers of the invention to be rooted on the doll's head can be reduced to 60 to 50% of the amount of the known fibers for the doll's head such as vinylidene chloride fibers.

In addition to the ingredients used in the Examples, other ingredients can be used in the Examples as set forth in the specification to obtain substantially the same results.

What we claim is:

1. A doll having hair comprising a multiplicity of multi-filaments of about 200 to 2,000 denier each comprising a multiplicity of mono-filaments of about 10 to 100 denier and comprising an acrylonitrile copolymer comprising 30 to 80% by weight of acrylonitrile units and 20 to 70% by weight units of at least one of vinyl chloride and vinylidene chloride; which filaments have an irregular surface unevenness of up to about 5 microns in distance from the bottom to the top thereof sufficient to reduce the shininess thereof.

2. A doll as claimed in claim 1 having hair comprising mono-filaments which have non-circular cross-sections.

3. A doll as claimed in claim 2 wherein said fiber has a cross-sectional shape at least one shape selected from the group consisting of a horseshoe-shaped shape, a cocoon-shaped shape, and L-shaped shape, a Y-shaped shape and a round shape.

* * * * *